US009278733B2

(12) United States Patent
Baugh et al.

(10) Patent No.: US 9,278,733 B2
(45) Date of Patent: Mar. 8, 2016

(54) METHOD OF SINGLE LINE MOORING

(71) Applicants: Benton Frederick Baugh, Houston, TX (US); Michael Leroy Spence, Tulsa, OK (US)

(72) Inventors: Benton Frederick Baugh, Houston, TX (US); Michael Leroy Spence, Tulsa, OK (US)

(73) Assignee: Reel Power Licensing Corp., Oklahoma City, OK (US)

( * ) Notice: Subject to any disclaimer, the term of this patent is extended or adjusted under 35 U.S.C. 154(b) by 200 days.

(21) Appl. No.: 13/894,383

(22) Filed: May 14, 2013

(65) Prior Publication Data

US 2014/0338582 A1 Nov. 20, 2014

(51) Int. Cl.

| | |
|---|---|
| ***B63B 21/00*** | (2006.01) |
| ***B63B 21/50*** | (2006.01) |
| ***B63B 22/04*** | (2006.01) |
| ***B63B 22/18*** | (2006.01) |
| ***B63B 22/20*** | (2006.01) |
| ***B63B 21/29*** | (2006.01) |
| ***B63B 21/46*** | (2006.01) |
| *B63B 21/20* | (2006.01) |
| *B63B 21/22* | (2006.01) |

(52) U.S. Cl.

CPC ..... *B63B 21/00* (2013.01); *B63B 21/29* (2013.01); *B63B 21/46* (2013.01); *B63B 21/50* (2013.01); *B63B 21/502* (2013.01); *B63B 22/04* (2013.01); *B63B 22/18* (2013.01); *B63B 22/20* (2013.01); *B63B 2021/003* (2013.01); *B63B 2021/206* (2013.01); *B63B 2021/225* (2013.01)

(58) Field of Classification Search

CPC ..... B63B 21/00; B63B 2021/003; B63B 2021/004; B63B 2021/005; B63B 2021/206; B63B 21/22; B63B 2021/225; B63B 21/50; B63B 2021/505; B63B 21/507; B63B 21/508; B63B 22/02; B63B 22/025; B63B 22/04; B63B 22/18; B63B 22/20; E02B 3/24; F03B 13/12; F03B 13/16; F03B 13/18; F03B 13/20

USPC ..... 114/230.2–230.3; 405/223.1–228

See application file for complete search history.

(56) References Cited

U.S. PATENT DOCUMENTS

| | | | | | |
|---|---|---|---|---|---|
| 819,006 | A * | 4/1906 | Dempsey | 60/504 |
| 2,686,491 | A * | 8/1954 | Ohmstede | 114/230.23 |
| 2,986,889 | A * | 6/1961 | Ludwig | 405/224 |
| 3,695,207 | A * | 10/1972 | Atlas | 114/294 |
| 3,775,787 | A * | 12/1973 | Rager | 441/23 |
| 7,874,886 | B2 * | 1/2011 | Fowler et al. | 441/11 |
| 2003/0227173 | A1 * | 12/2003 | Gorshkov | 290/53 |
| 2009/0212562 | A1 * | 8/2009 | Jaugilas | 290/42 |

FOREIGN PATENT DOCUMENTS

| | | | | |
|---|---|---|---|---|
| JP | 61255277 | A * | 11/1986 | F03B 13/20 |
| JP | 04078687 | A * | 3/1992 | B63B 22/00 |
| JP | 06056080 | A * | 3/1994 | B63C 11/00 |

* cited by examiner

*Primary Examiner* — Ajay Vasudeva

(74) *Attorney, Agent, or Firm* — Martin G. Ozinga; Phillips Murrah PC

(57) ABSTRACT

The method of mooring buoyant equipment at the surface of a body of water in a controlled position using a single line by connecting a first line from the buoyant equipment to a first diameter drum on a subsea mooring tower, connecting the first diameter drum to a second diameter drum, connecting a second line from the second diameter drum to a weight, such that when the depth of the body of water changes the tension on the first line remains the same and the vertical distance travelled by the weight is less than the change in the depth of the body of water.

1 Claim, 7 Drawing Sheets

METHOD OF SINGLE LINE MOORING

TECHNICAL FIELD

This invention relates to the method of using a single line to moor a vessel within a tight watch circle in a body of water of varying depth.

BACKGROUND OF THE INVENTION

Conventional mooring of a vessel using a single line generally involves dropping an anchor and letting the vessel weathervane to the downstream position from the anchor point. The variability of the depth must be considered in the amount of anchor line which if deployed. Consider, for example, water level varies between 100 foot depth and 400 foot depth and the anchor is set tightly when the water is at a depth of 100 feet. When the water depth moves towards 400 feet, the anchor line will either hold the vessel down until it sinks, the anchor line will be broken, or the anchor will be pulled out of the floor below the body of water. All three options are potentially bad.

Such a variability of depth occurs in situations such as sanitation ponds where the water level varies substantially over the seasons. In sanitation ponds, it is useful to moor multiple vessels on the surface of the water in specific locations for a variety of tasks. One of these tasks would be to support solar cells and pumps. These pumps can spray the sanitation water into the air for aeration and to promote the improvement of its quality. Other applications would be to support wind energy generation equipment and water quality measurement instrumentation.

The greatest benefit can be realized from equipment such as this by having the maximum number of units in the water with the tightest possible spacing. This means that the watch circle or area of movement of each unit should be as small as practical. Dense spacing and large watch circles would mean that they would tangle with one another and interfere with the operations.

BRIEF SUMMARY OF THE INVENTION

The object of this invention is to provide a method of mooring vessels within a tight water circle on the surface of a body of water of varying depth.

A second object of this invention is to provide passive means to control the watch circle.

A third objective of this invention is to provide a single line mooring system whose watch circle is defined by an inverted cone whose size is depth insensitive for a range of depths.

DETAILED DESCRIPTION OF THE INVENTION

Figure 1:
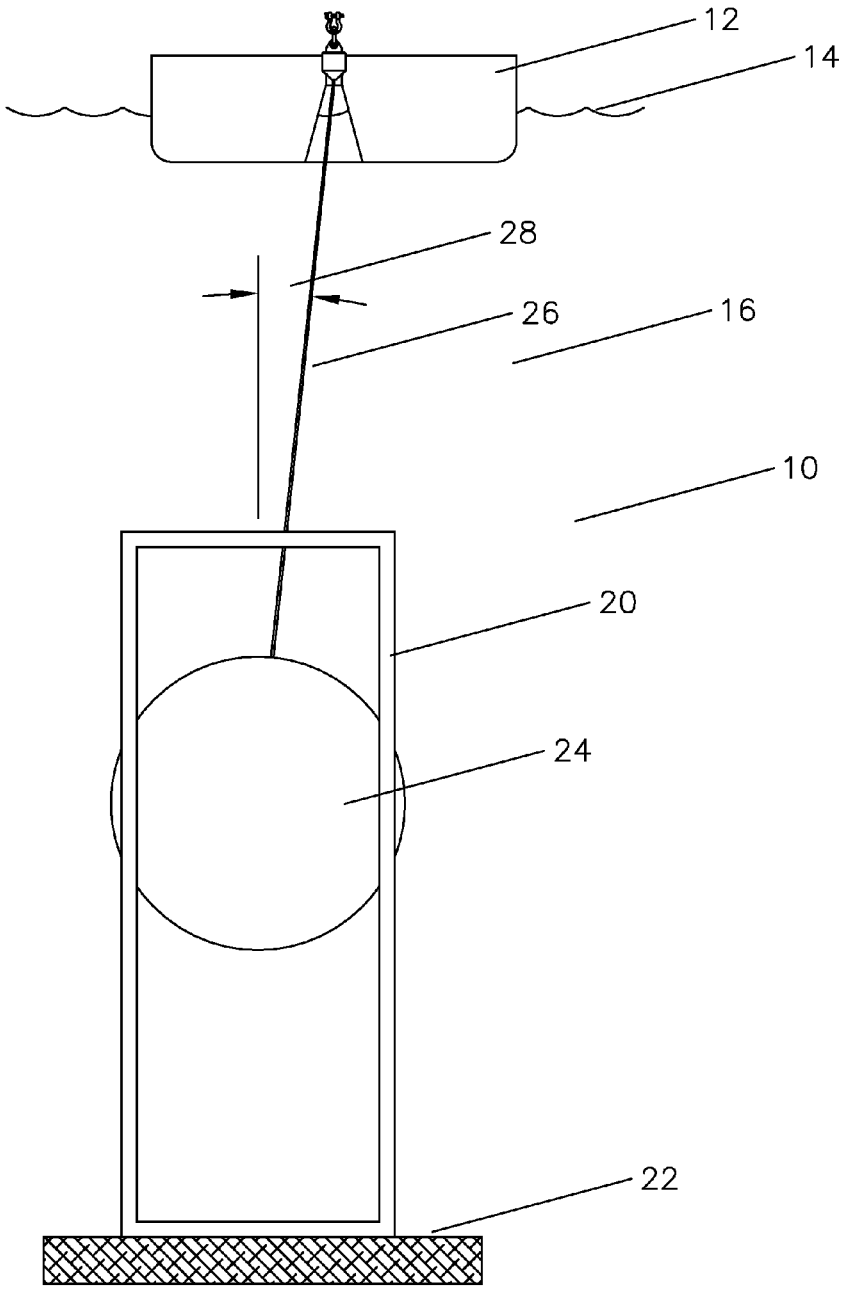
FIG. 1 is a schematic of the method of this invention showing a simplistic guided weight establishing a controlled watch circle for a vessel in a body of water which has a limited change in depth.

Referring now to FIG. 1, a view of a complete system for the single line mooring system 10 is shown with vessel 12 at the surface 14 of the body of water 16. Mooring structure 20 is landed on the floor 22 of the body of water and contains a weight 24 with a line 26 up to vessel 12. Line 26 is shown at angle 28 from vertical which would be variable based upon water currents and wind speeds. Angle 28 will be constant for a fixed or maximum water current and wind speed. In this figure, weight 24 simply moves up and down within mooring structure 20 with a constant line length and so the water working depth range of the system as shown would be generally the height of the mooring tower 20.

Figure 2:
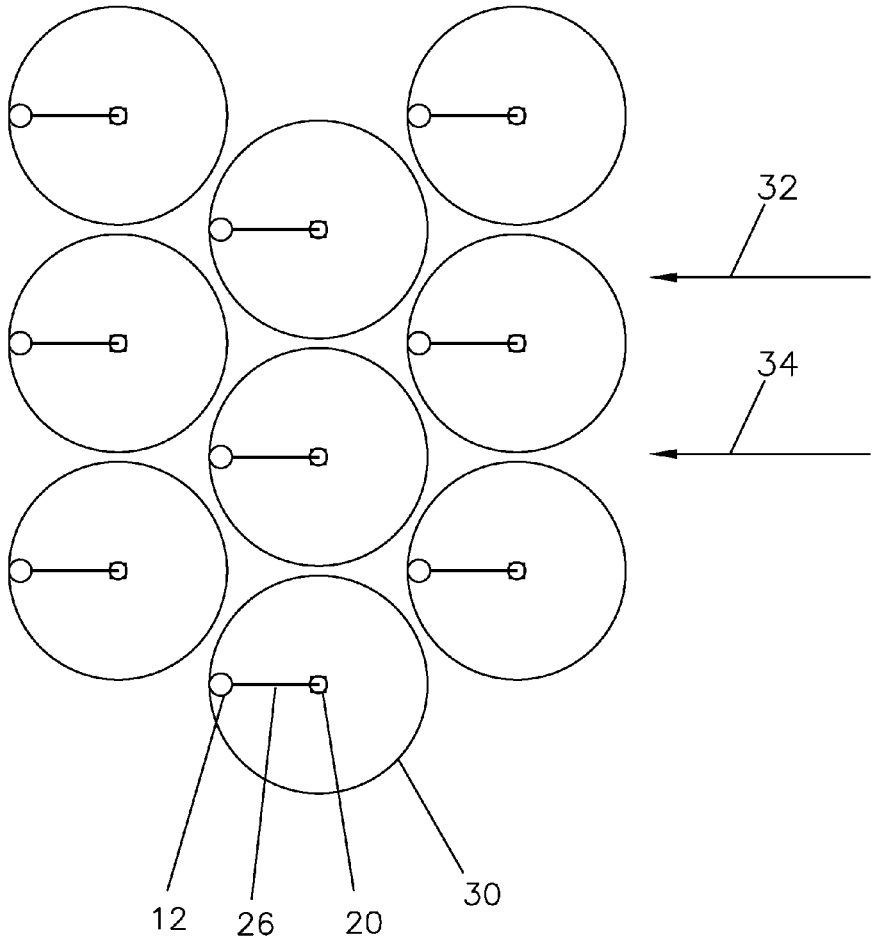
FIG. 2 is generally a top view of the equipment shown in FIG. 1 repeated several times in a pattern and showing the watch circles of the vessel of this equipment.

Referring now to FIG. 2 which is a vertical view of what is shown in in FIG. 1 shown several times, watch circle 30 is shown around several vessels 12 which are shown at maximum current 32 and maximum winds speed 34. At these maximum conditions, the diameter of watch circle 30 is of a maximum diameter, and these maximum diameter watch circles do not overlap. At shallower depths within the working depth range, lower current speeds, and lower wind speeds, the watch circles would be the same size or smaller.

If you can imagine alternately, that the vessel is simply anchored with the same line length, when the level of the water goes down the watch circle becomes larger as the angle 28 becomes larger. This is particularly sensitive when there is no significant current or wind and the vessels 12 simply wander around and become tangled.

Figure 3:
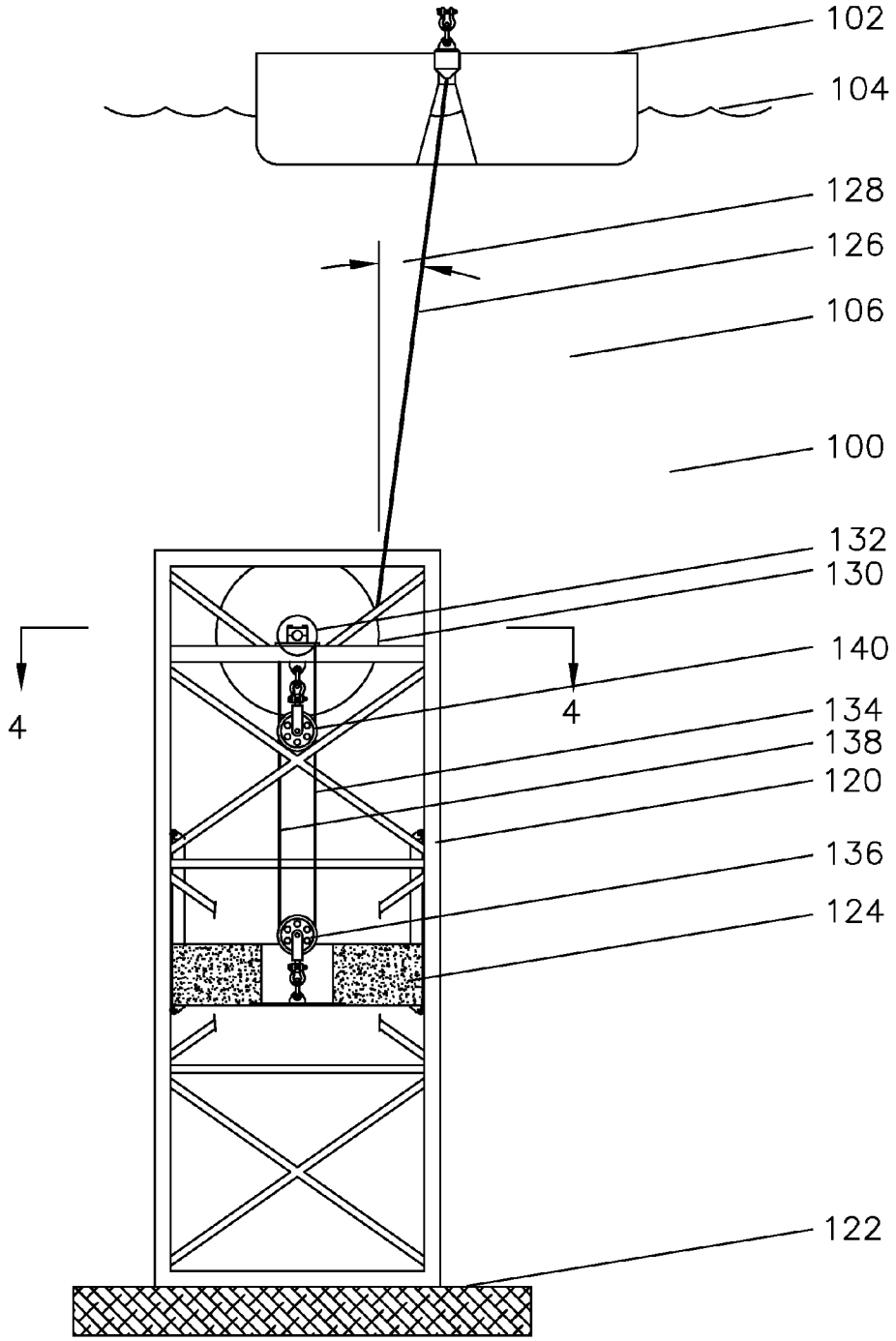
FIG. 3 is a view of equipment similar to the equipment shown in FIG. 1 also including a block and tackle arrangement to allow accommodating a greater range of depths for a limited vertical travel of the weight.

Referring now to FIG. 3, a view of a complete system for the single line mooring system 100 is shown with vessel 102 at the surface 104 of the body of water 106. Mooring structure 120 is landed on the floor 122 of the body of water 106 and contains a weight 124 with a line 126 up to vessel 102. Line 126 is shown at angle 128 from vertical which would be variable based upon water currents and wind speeds. Angle 128 will be constant for a fixed or maximum water current and wind speed.

Line 126 is connected to drum 130 which is in turn connected to drum 132. Line 134 is attached to drum 132 and goes down to sheave 136 and back up as line portion 138 to sheave 140. It returns to sheave 136 as a block and tackle arrangement. This takes the available vertical movement available for weight 124 within mooring structure 120 and amplifies the vertical motion by a factor such as 8/1 in exchange for force reduction of 1/8. This retains the ability to maintain a tight watch circle as seen in FIG. 2 but gives much more vertical flexibility than the concept as shown in FIG. 1. The exchange of distance amplification at the expense of loadings is shown as accomplished by a combination of different drum diameters and a block and tackle arrangement. A gear box can be similarly used in this process to replace either the difference in drum diameters or the block and tackle, or to supplement them.

Figure 4:
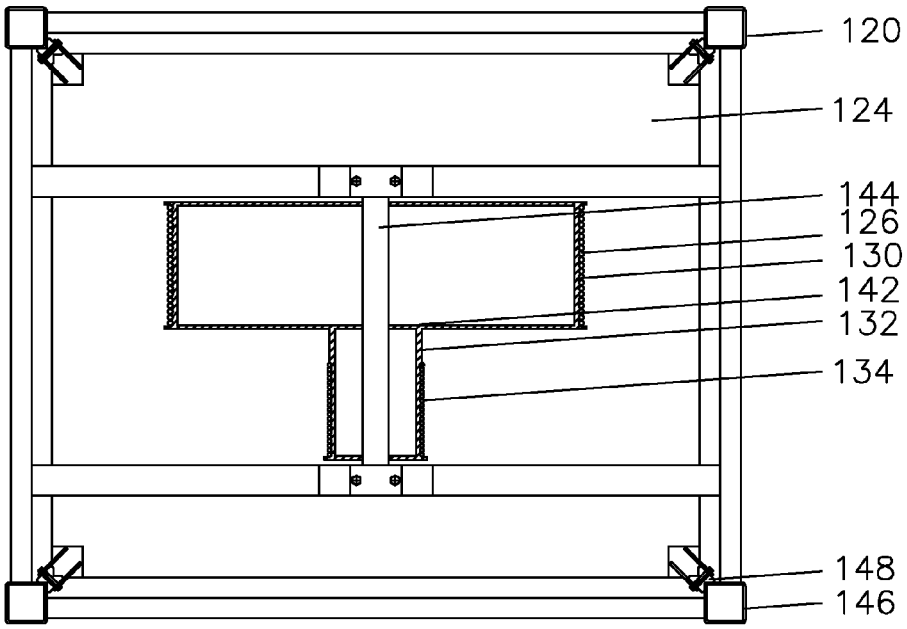
FIG. 4 is section view of FIG. 3 taken along lines "4-4" giving a better view of the dual drum arrangement for increasing greater depth range.

Referring now to FIG. 4, drum 130 is shown attached to drum 132 at 142 about axles 144, with lines or wire ropes 126 and 134 attached to the drums 130 and 132 respectively. Structure 120 is shown fabricated of square tubing 146. Weight 124 has rollers 148 which guide weight 124 and it moves up and down.

Figure 5:
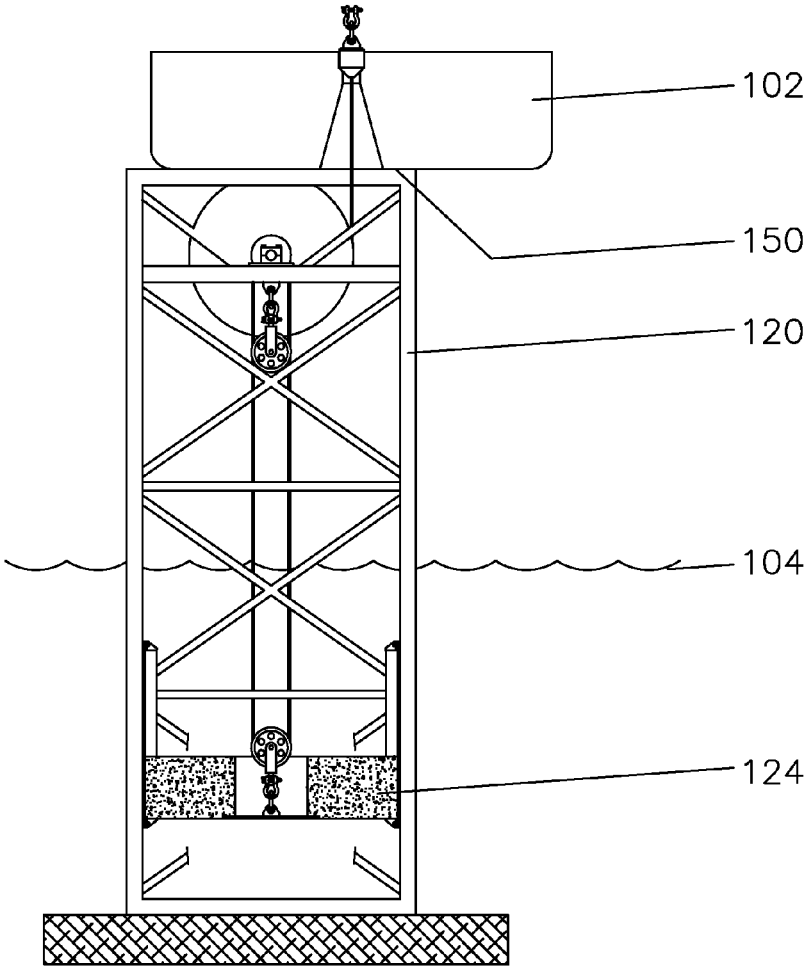
FIG. 5 is a view similar to FIG. 3, when the water level has been reduced to below the top of the mooring tower and the floating vessel has simply landed on the mooring tower.

Referring now to FIG. 5, the depth of the water is at an extremely low depth with the surface 104 shown below the top 150 of the mooring tower 120. At this time the weight 124 has moved to its lowest position and is stationary there as the depth of the water varies within the height of the mooring tower 120.

Figure 6:
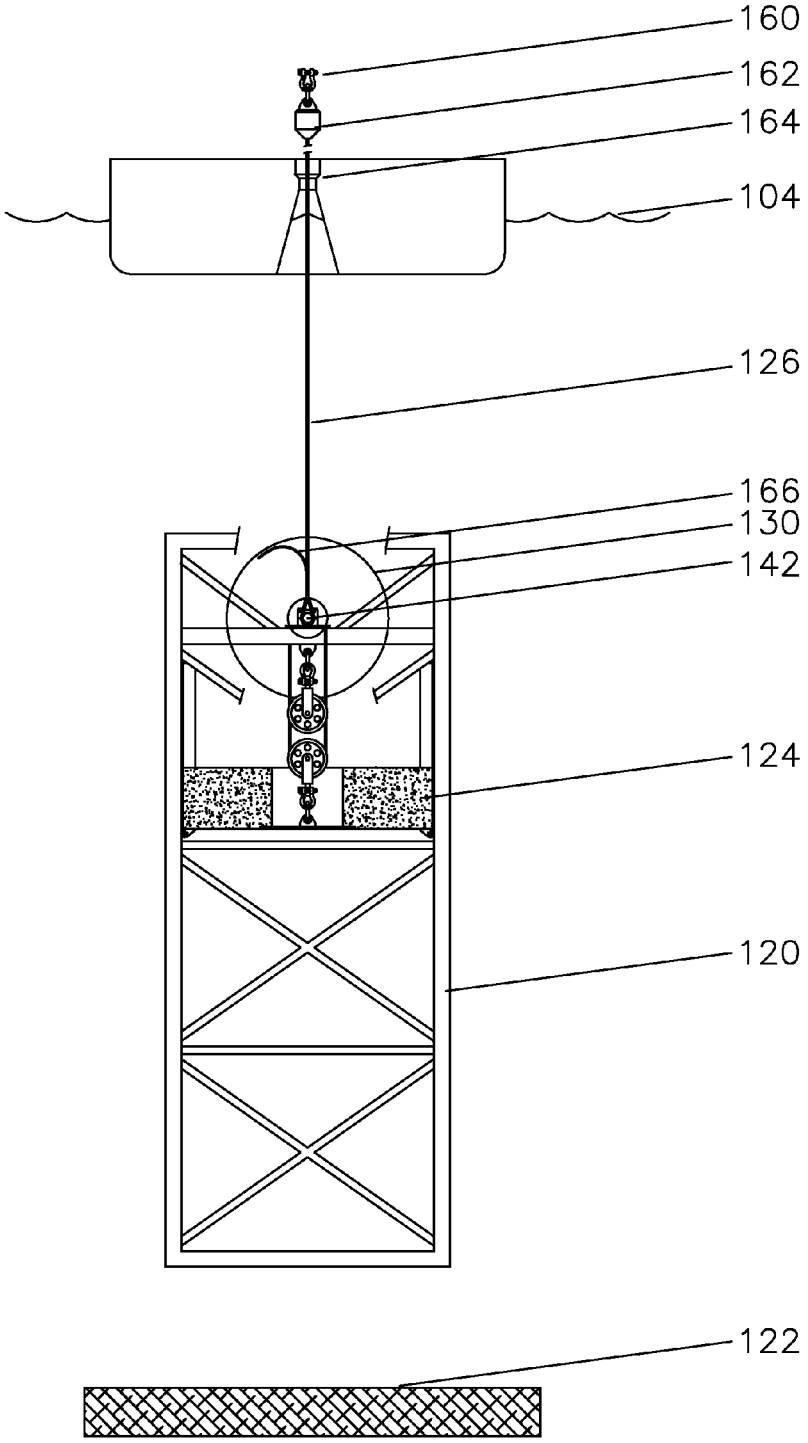
FIG. 6 is a view of the equipment of FIG. 3, starting the process of removing the equipment, or the final stage of landing the equipment on the floor of the body of water during installation.

Referring now to FIG. 6, line 126 is picked up by lifting on shackle 160 such that mandrel 162 is lifted off seat 164 to the point that mooring structure 120 is lifted off the floor 122. Weight 124 is moved to its top position within structure 120. Cable 126 is shown as it is pulled to the end going down turndown ramp 166 and is attached to axle 142. When the cable directly supports the mooring structure 120 at axle 142, the upward movement of the weight 124 within the mooring structure 120 is stopped.

Figure 7:
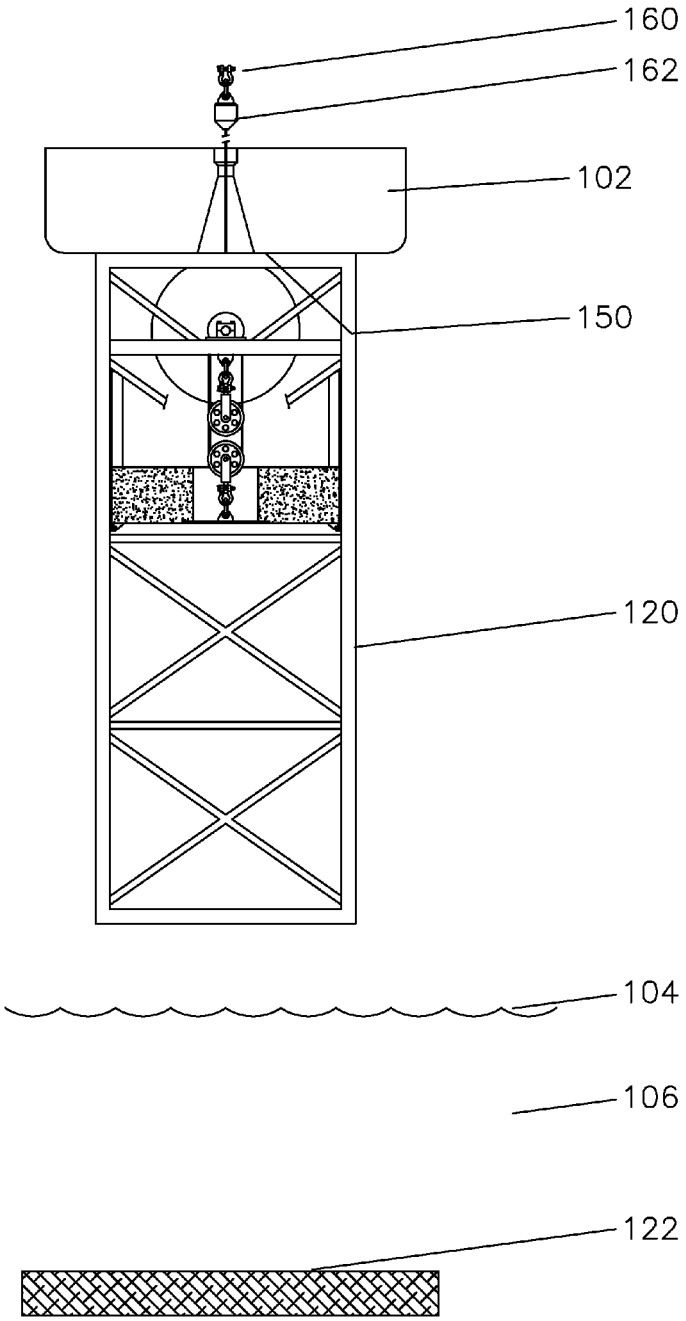
FIG. 7 is a view of the equipment of FIG. 3 with the equipment lifted completely out of the body of water or about to be installed in the water during installation.

Referring now to FIG. 7 when the mooring structure 120 completely out of the body of water 106, the top 150 of the mooring structure 120 engages the bottom of the vessel 102 and the complete package is lifted out for servicing, repositioning, or replacement.

The procedures indicated by FIGS. 6 and 7 are generally reversed for installation of the system.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

That which is claimed is:

1. The method of mooring buoyant equipment at the surface of a body of water in a controlled position using a single line, comprising connecting a first line from said buoyant equipment to a first diameter drum on a subsea mooring tower, connecting said first diameter drum to a second diameter drum, connecting a second line from said second diameter drum to a weight, such that when the depth of said body of water changes the tension on said first line remains the same and the vertical distance travelled by said weight is less than the change in the depth of said body of water and wherein said first diameter drum is of a larger diameter than said second diameter drum.

* * * * *